US005728963A

United States Patent [19]

Reintjes

[11] Patent Number: 5,728,963

[45] Date of Patent: Mar. 17, 1998

[54] LOW-POWER MUSIC SYNTHESIZER AND TRANSMITTER

[76] Inventor: Peter B. Reintjes, 3324 Chatelaine Blvd., Delray Beach, Fla. 33445

[21] Appl. No.: 669,986

[22] Filed: Jun. 22, 1996

[51] Int. Cl.[6] ..... G10H 1/06; G10H 5/00

[52] U.S. Cl. ..... 84/692; 84/699

[58] Field of Search ..... 84/659, 662, 692, 84/70, 733, 699

[56] References Cited

U.S. PATENT DOCUMENTS

| | | | |
|---|---|---|---|
| 3,662,641 | 5/1972 | Allen et al. . | |
| 3,944,843 | 3/1976 | Van Martins | 307/116 |
| 4,044,642 | 8/1977 | Pearlman et al. . | |
| 4,099,437 | 7/1978 | Stavron et al. | 84/1.01 |
| 4,105,902 | 8/1978 | Iwai et al. | 307/308 |
| 4,152,629 | 5/1979 | Raupp | 315/362 |
| 4,160,923 | 7/1979 | Maeda et al. | 307/308 |
| 4,186,641 | 2/1980 | Dorfman | 84/1.16 |
| 4,289,980 | 9/1981 | McLaughlin | 307/308 |
| 4,503,745 | 3/1985 | Clark, Jr. et al. . | |
| 5,007,324 | 4/1991 | DeMichele | 84/741 |
| 5,025,704 | 6/1991 | Davis | 84/723 |
| 5,262,585 | 11/1993 | Greene et al. | 84/645 |
| 5,422,955 | 6/1995 | Guzman | 381/77 |
| 5,434,350 | 7/1995 | Haney et al. | 84/730 X |
| 5,576,507 | 11/1996 | LaMarra | 84/645 |

OTHER PUBLICATIONS

Build a Portable Synthesizer Nov. 1975 John S. Simonton Radio Electronics.

Surf Synthesizer Feb. 1972 John S. Simonton Popular Electronics.

CMOS Linear Applications 1975 Gene Taatjes National Semiconductor Data Book

FM Wireless Microphone 1994 Radio Shack ® Part #28–4030.

Surfman Surf Synthesizer Aug. 1992 John S. Simonton Electronics Now.

Timekeepin Adv. Through Cosmos Tech 1973 S.S. Eaton RCA COS/MOS Data Book.

*Primary Examiner*—William M. Shoop, Jr.
*Assistant Examiner*—Jeffrey W. Donels
*Attorney, Agent, or Firm*—Kudirka & Jobse, LLP

[57] ABSTRACT

This patent application describes a low-power electronic music synthesizer (1) which may be combined with a radio transmitter (2) for use in audio-kinetic sculptures or toys. The invention consists of a low-voltage circuit implementing a multiple voice analog music synthesizer utilizing digital CMOS invertors biased in their linear regions as push-pull amplifiers and field-effect transistors as parameter controlling elements. Because of the low-voltage operation, a charge-pump is required to produce a negative control voltage for the field-effect transistors. Variations in sound are produced by touching metal contacts (3,4,5,6,7,8,9,10) which are sensitive to the range of resistance and capacitance of human fingertips. The combination of low-voltage, low-power, high-fidelity sound generation and touch-sensitive controls make this ideal for a new kind of toy. Due to the low-voltage and low-power requirements, the circuit can operate for approximately forty hours using two 1.5 volt AA cells. In the demonstration models an FM transmitter is employed, but any suitable part of the radio spectrum could be used subject to FCC emission regulations and the availability of receivers.

21 Claims, 10 Drawing Sheets

LOW-POWER MUSIC SYNTHESIZER AND TRANSMITTER

FIELD OF THE INVENTION

This invention relates to electronic music instruments and the technique of using short-range radio transmission to employ standard broadcast-band radio receivers as a sound-producing means for musical instruments and sound making toys.

DESCRIPTION OF PRIOR ART

FCC regulations allow for the unlicensed operation of low-power transmitters in the FM and AM bands when the range of such transmissions is limited to a few hundred feet. This allows for the natural exploitation of the high-quality sound available from car radios, portable radios, and home high-fidelity systems. In particular, musical instruments fitted with transmitters allow musicians to use amplified instruments without the need for cables between the instrument and amplifier.

Prior art deals almost exclusively with audio transducers and the transmission of audio signals from traditional musical instruments. U.S. Pat. No. 5,422,955 to Guzman and Hildesheim (1995) covers aspects of transmission of sound from acoustic instruments. U.S. Pat. No. 5,025,704 to Davis (1991) deals with electric guitars or other instruments containing built-in pickups. U.S. Pat. No. 4,186,641 to Dorfman (1980) is a patent for toy musical instruments. These patents are concerned with transducers and methods of broadcasting the sounds from traditional acoustic and electric musical instruments. A problem with applying these inventions is that such toys or musical instruments cannot be miniaturized beyond a certain point because the strings and acoustic surfaces must resonate at audio frequencies.

Other patents are concerned with the transmission of information from purely electronic musical instruments. U.S. Pat. Nos. 4,099,437 to Stavrou and Slack (1978) and 5,007,324 to DeMichele (1991) describe keyboard instruments which transmit coded signals to specialized receivers. These receivers must decode the signals and produce the corresponding sounds. This technique does not take advantage of standard broadcast-band radios and is expensive to implement.

An example of a miniature electronic music synthesizer has been described by Simonton in "Build a Portable Synthesizer", an article in the November 1975 issue of *Radio-Electronics*. Simonton has also developed special-purpose sound-effect generators such as the "Surfman" surf synthesizer described in the August 1992 issue of *Electronics Now*. Such portable synthesizers or sound-effect generators require external amplification systems or headphones. These and other recent analog music synthesizer designs make heavy use of operational amplifier integrated circuits. Operational amplifier circuits require power supplies with both a positive and negative voltage relative to a zero-volt reference. Simonton's 1975 design utilizes dual 9-volt batteries to supply the symmetrical two-voltage supply. The "Surfman" (1992) uses a single 9-volt batter and utilizes a voltage divider to create a voltage midway between the positive and negative supply. While simpler than the dual-voltage power supply, the "Surfman" requires this extra circuitry which consumes approximately twenty percent of the total power required by the circuit.

The state-variable filter topology is employed in many electronic synthesizers. This design was first presented in 1967 by L. P. Huelsman, W. J. Kerwin, and R. W. Newman in "State Variable Synthesis for Insensitive Integrated Circuit Transfer Functions.", *IEEE Journal of Solid-State Circuits*, Volume SC-2, Number 3, September 1967. Active filters of this design are universally described as operational amplifier circuits. As described above, operational amplifiers require dual-voltage power supplies or some means of generating a reference voltage between the power supply voltages, have a higher cost, and increase the parts count of simple circuits.

Synthetic sounds which mimic the natural sounds of rain, surf, thunder or percussion sounds such as drums and explosions require a source of broad spectrum noise. Two kinds of broadband noise are white noise and pink noise. White noise is a signal which contains equal energy per unit of frequency. This frequency distribution is also referred to as equal energy per bandwidth and is similar to the inter-station hiss heard in radio receivers. Pink noise is similar but contains equal energy in each octave of frequency. Pink noise has much greater low-frequency amplitude components than white noise and is closer to natural noise sources such as waterfalls, rain, thunder, and the crash of ocean waves breaking on the shore.

For the purpose of producing sound-effects, these terms are used loosely. A noise source with relatively uniform spectrum is referred to as white noise. A noise source with any degree of low-frequency emphasis is called pink noise.

The prior art shows two methods for producing white noise. The first is to reverse-bias a PN junction with sufficiently high voltage to drive the junction into avalanche, or zener-breakdown mode. The base-emitter junction in small-signal transistors such as a 2N2712 is commonly used because it will break down at approximately 15 volts. However, for battery-powered toys, this is an inconveniently high voltage. An early version of Simonton's surf synthesizer used two 9-volt batteries to achieve an 18-volt power supply and his more recent Surfman design (1992) uses a voltage doubler to boost a single 9-volt supply to a sufficient level for the white-noise generator. Low-voltage zener diodes would seem to be ideal for a low-voltage application, but they are relatively expensive and are often designed specifically to have low noise levels.

The second method employs a high-frequency oscillator driving a digital shift register. If the outputs from the $14^{th}$ and $17^{th}$ stages of a shift register are fed into an exclusive-or gate and the result connected to the shift register input, the resulting pseudo-random bit sequence gives a good approximation of white noise. This technique is compatible with low voltage operation, but requires a moderately complex circuit.

There are numerous one and two-transistor FM transmitter designs that would be suitable for this invention. Several are found in *Encyclopedia of Electronic Circuits*, Volumes 1–5 compiled by Graf and Sheets, TAB Books, 1992. FIG. 3 shows a convenient design which isolates the antenna from the FM modulator. This makes the transmitter frequency less sensitive to movement or a person coming in contact with the antenna. This circuit is based upon a wireless microphone kit, catalog number 28-4030 sold by the Radio Shack division of Tandy Corporation. Modifications have been made to the circuit for 3-volt operation.

The wide dynamic range of musical instruments is the source of significant problems in wireless transmission. Unless the dynamic range is compressed and limited, the radio signal can be too weak, or over-modulate the carrier causing wide-band interference, or very likely alternate between these two conditions. Attempts are made to address this problem in Stavrou and DeMichele by transmitting coded information about the dynamics of the performance to specialized sound-producing equipment in the receiver. These approaches lose the advantages of using standard broadcast-band receivers as the sound producing medium. Doffman, Davis, and Guzman do not address the problems of dynamic range.

The use of touch sensitive controls as an indirect method of producing variations in sound encourages experimentation which is an essential element of an educational toy. There are many patents on touch-sensitive switches such as U.S. Pat. No. 3,944,843 to Vaz Martins (1976), U.S. Pat. No. 4,105,902 to Iwai, Shimoi, and Kawamura (1978), U.S. Pat. No. 4,152,629 to Raupp (1979), U.S. Pat. No. 4,160,923 to Maeda and Ohba (1979) and U.S. Pat. No. 4,289,980 to McLaughlin (1979) but all relate to switches with a transition from fully-off to fully-on. None of the prior art describes an inexpensive means to produce a continuous variation in resistance or control voltage which is related to the pressure applied to a pair of touch-sensitive contacts.

SUMMARY OF THE INVENTION

This invention is a wireless musical instrument based upon an exceptionally small analog music synthesizer. High-fidelity radio receivers are widely available in the form of portable units, car radios, or home hi-fi systems. By exploiting the sound quality available from these receivers, an extremely small musical instrument can produce harmonically rich sounds at high volume levels.

This circuit improves upon existing sound-making toys by producing a wide range of high fidelity sounds using readily available radio receivers as the sound-producing medium. The use of a radio transmitter eliminates the need to include amplification and sound-producing means in the circuit. Sound-producing toys with built-in amplifiers and speakers are more expensive to produce, require more power and produce inferior sound quality.

The micro-power synthesizer presented here is not restricted to an application involving radio transmission. However, a wireless configuration is the principal application that can take full advantage of the design. If a micro-power synthesizer were combined in one unit with an amplifier and speaker, the size, weight, and lowpower advantages would be lost. In addition, a built-in amplifier would almost certainly lack the sound quality available from even a modestly priced portable or car radio. Similarly, if the micro-power synthesizer were connected via a cable to an amplification system, the advantages of portability and long battery life become less important.

The technique of using CMOS invertors as linear amplifiers leads to circuit simplifications, lower power, and lower voltage requirements than any existing music synthesizer designs. Other electronic music synthesizers are universally designed around operational amplifiers. Quad operational amplifier integrated circuits are available in 14-pin packages for about 30 cents per amplifier. 14-pin ICs with six CMOS invertors reduce this cost to around 4 cents per amplifier while also reducing the number of parts.

Novel white and pink noise generators for low-voltage circuits are presented. The addition of these noise sources as an input to voltage-controlled filters provides the synthesizer with the ability to mimic natural sounds such as the wind, rain, and surf.

Touch-sensitive controls for continuously variable sound modification are presented. The use of touch-sensitive controls as an indirect method of varying sound encourages experimentation. Such experimentation is an essential element of an educational toy. The use of touch-sensitive contacts also reduces the size and cost of the circuit and increases reliability by eliminating mechanical controls.

An electronic musical instrument can be miniaturized arbitrarily and still produce sounds which span the audio spectrum. This is in contrast to the limitations on the pickup and transmission of sounds from traditional musical instruments discussed in the prior art. The reduced power requirements and simplified circuitry of this invention allow for extensive miniaturization. A complete electronic music synthesizer with fingertip touch-controls and an FM transmitter takes up less than one-quarter of a cubic inch and can operate for approximately forty hours using two 1.5 volt AA cells.

By combining these elements in a portable musical instrument or toy, one achieves lower manufacturing costs, smaller size, reduced power-supply requirements, higher quality sound, and the convenience of wireless operation. These advantages cover nearly all possible areas of improvement.

Smaller size
Low voltage operation
Long battery life
Simple power supply requirements
Reduced parts count
Less expensive components
Better sound quality
Elimination of moving parts
Increased reliability

DETAILED DESCRIPTION

Figure 1:
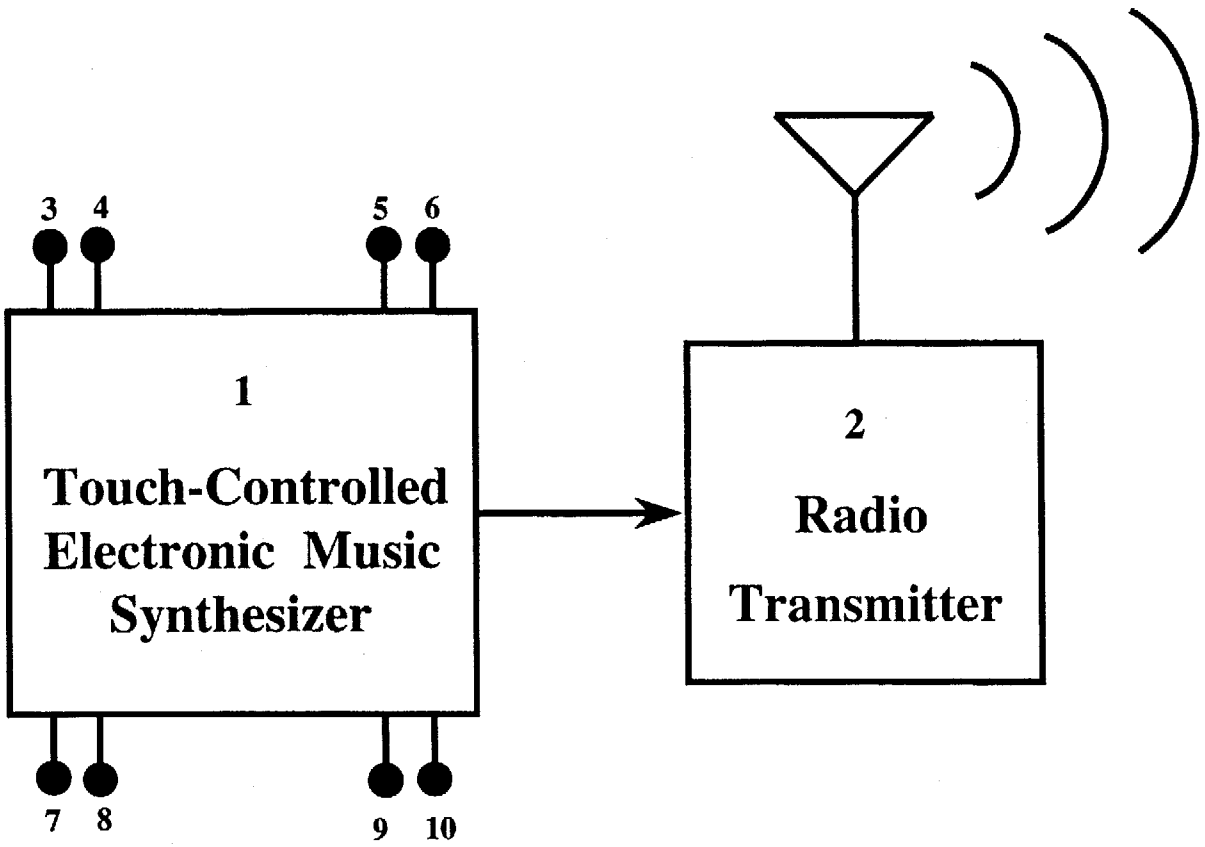
FIG. 1 shows an overall view of the music synthesizer and transmitter.

For convenience the reference numerals have been grouped according to the first figure in which they appear.

FIG. 1

1 Electronic music synthesizer with touch-sensitive controls
2 Low-power broadcast-band radio transmitter
3 Touch contact for first oscillator frequency control
4 Touch contact for first oscillator frequency control
5 Touch contact for first oscillator tone control
6 Touch contact for first oscillator tone control
7 Touch contact for second oscillator frequency control
8 Touch contact for second oscillator frequency control
9 Touch contact for second oscillator tone control
10 Touch contact for second oscillator tone control

FIG. 2

11 Variable frequency square-wave oscillator
12 Variable frequency square-wave oscillator 13 White Noise Generator
14 Voltage-controlled Band-Pass Filter
15 Voltage-controlled Band-Pass Filter
16 Negative Voltage Generator
17 Skin resistance to control-voltage converter
18 Skin resistance to control-voltage converter
19 Summing Amplifier Mixer

FIG. 3

20 0.22uf variable oscillator timing capacitor
21 CMOS Schmitt-trigger—one sixth of integrated circuit 74HC14
22 1M timing resistor for variable oscillator
23 100pf coupling capacitor
24 100pf coupling capacitor
25 CMOS Inverter—one sixth of integrated circuit CD4069
26 100–1000pf filter frequency-range capacitor
27 100K resistor
28 CMOS Inverter
29 100K–470K filter gain resistor
30 1M filter time constant resistor
31 CMOS Inverter
32 100pf filter time constant capacitor
33 1M gain-setting feedback resistor
34 100K minimum gain setting feedback resistor
35 N-channel depletion-mode JFET transistor, type MPF102
36 0.1uf ultrasonic oscillator timing capacitor
37 CMOS Schmitt-trigger
38 100K timing resistor for ultrasonic oscillator
39 0.1uf AC coupling capacitor for negative voltage generator
40 Rectifying diode
41 Clamping diode
42 0.1uf filter capacitor for negative voltage generator
43 1M voltage divider resistor for control-voltage network
44 1M voltage divider resistor for control-voltage network
45 1M time delay resistor for control-voltage network
46 1.0uf filter capacitor for control-voltage network
47 100K resistor
48 100pf audio coupling capacitor
49 1M amplifier input resistor
50 CMOS Inverter
51 1M amplifier feedback resistor
52 1M amplifier input resistor

FIG. 4

62 6.8uf audio coupling capacitor
64 47K base bias resistor
66 100pf base capacitor
68 4pf modulator frequency capacitor
70 NPN high-frequency small-signal transistor, type 2N4401.
72 150 ohm emitter resistor
74 10pf capacitor
76 0.2–0.3 microHenry variable inductor with center tap
78 4pf coupling capacitor
80 47K gate bias resistor
82 NPN high-frequency small-signal transistor, type 2N4401.
84 220 ohm resistor

FIG. 5

88 0.001uf power-supply noise coupling capacitor
89 CMOS Inverter
90 10M feedback resistor
91 0.001uf audio coupling capacitor
92 1M input resistor
93 CMOS Inverter
94 10M feedback resistor
95 0.001uf audio coupling capacitor
96 1M input resistor
97 CMOS Inverter
98 10M feedback resistor

FIG. 6

100 0.001uf power-supply noise coupling capacitor
101 CMOS Inverter
102 100pf integrating capacitor
103 10M feedback resistor
104 100pf coupling capacitor
105 CMOS Inverter
106 100pf integrating capacitor
107 10M feedback resistor
108 100pf coupling capacitor

FIG. 7

120 Negative Voltage Generator
121 Pink Noise Generator
122 Voltage-controlled Low-pass Filter
123 Control-voltage envelope shaping network
124 0.1 Hz oscillator
125 0.2 Hz oscillator
126 0.1 Hz oscillator
127 Low-power radio transmitter

FIG. 8

130 0.1uf ultrasonic oscillator timing capacitor
131 CMOS Schmitt-trigger
132 100K ultrasonic oscillator timing resistor
133 0.1uf coupling capacitor
134 Rectifying diode
135 Clamping diode
136 0.1uf negative bias voltage filter capacitor
137 220K Control-voltage bias resistor
138 0.001uf power-supply noise coupling resistor
139 CMOS Inverter
140 18pf capacitor
141 1M feedback resistor
142 0.01uf coupling capacitor
143 CMOS Inverter
144 22pf integrating capacitor
145 10M feedback resistor
146 0.01uf coupling capacitor
147 220K Low-pass filter input resistor
148 0.01uf low-pass filter capacitor
149 470K low-pass gain resistor
150 CMOS Inverter
151 47K feedback resistor
152 18pf low-pass cutoff frequency capacitor
153 N-channel depletion-mode JFET transistor, MPF-102
154 0.01uf coupling capacitor
155 100K input resistor
156 CMOS Inverter
157 1M feedback resistor
158 10uf capacitor
159 1M resistor
160 CMOS Schmitt-trigger
161 1M resistor
162 6.8uf capacitor
163 1M resistor
164 CMOS Schmitt-trigger
165 1M resistor

Figure 2:
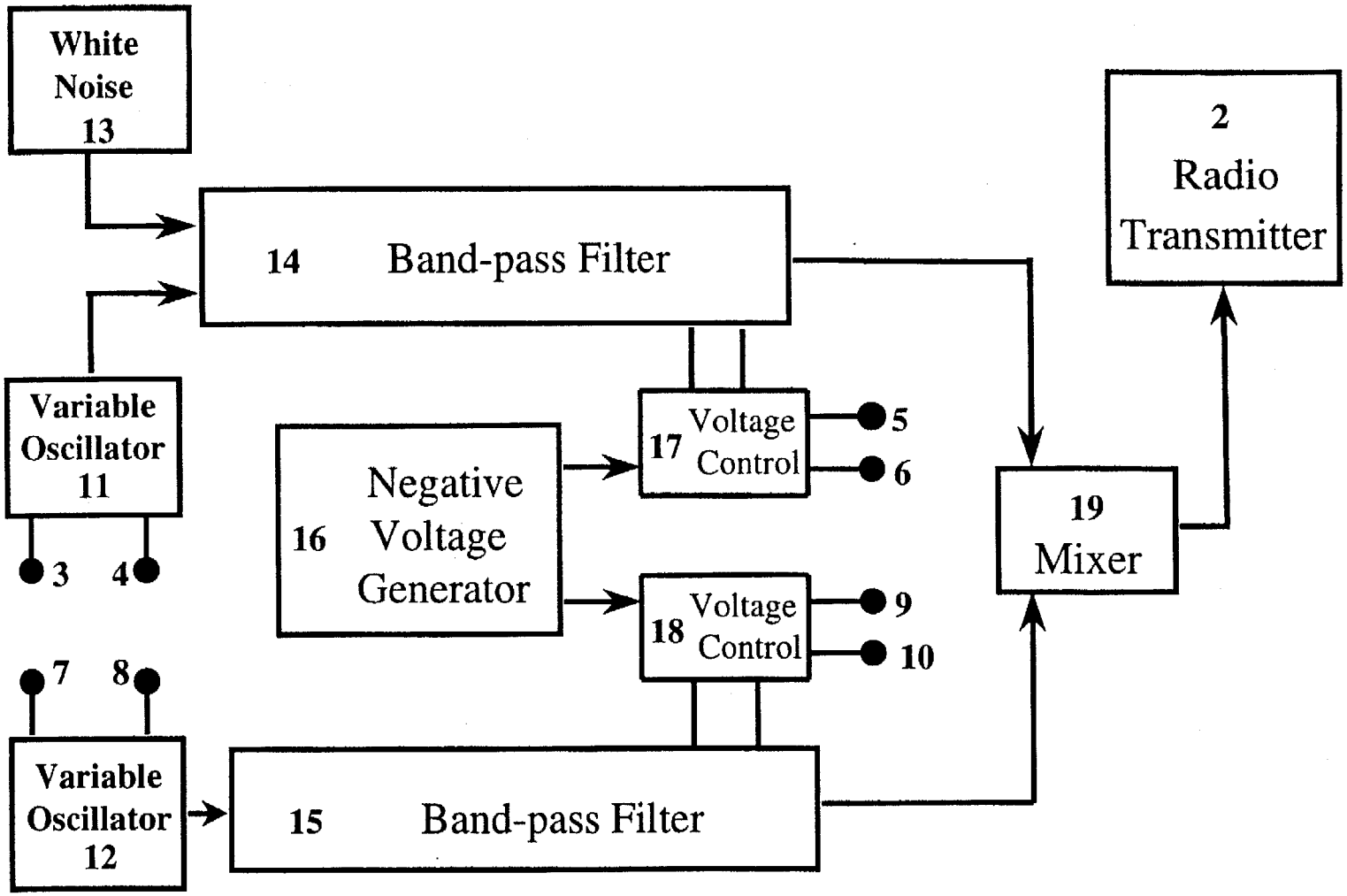
FIG. 2 shows a block diagram of the preferred embodiment.
Figure 2A:
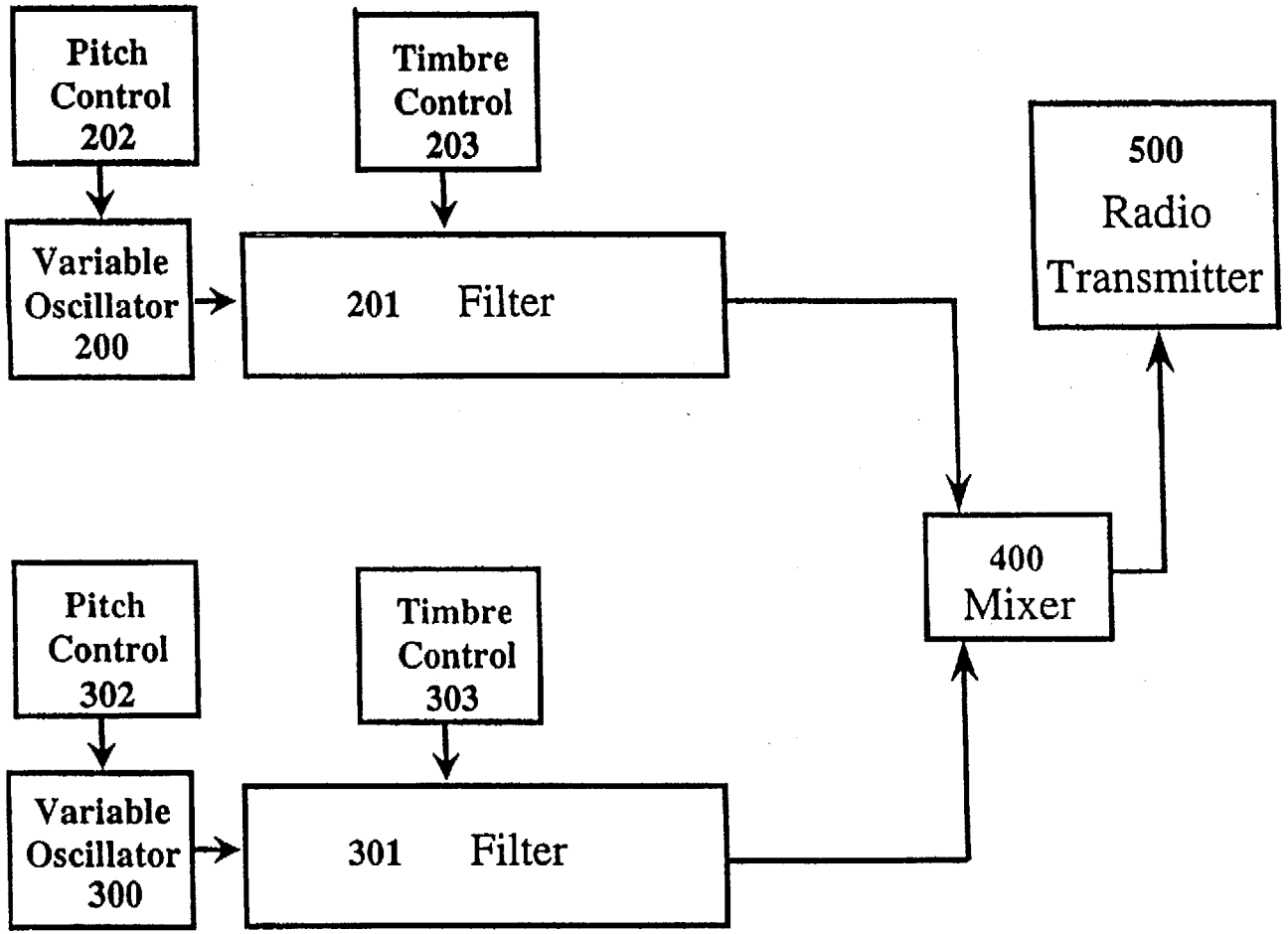
Figure 2B:
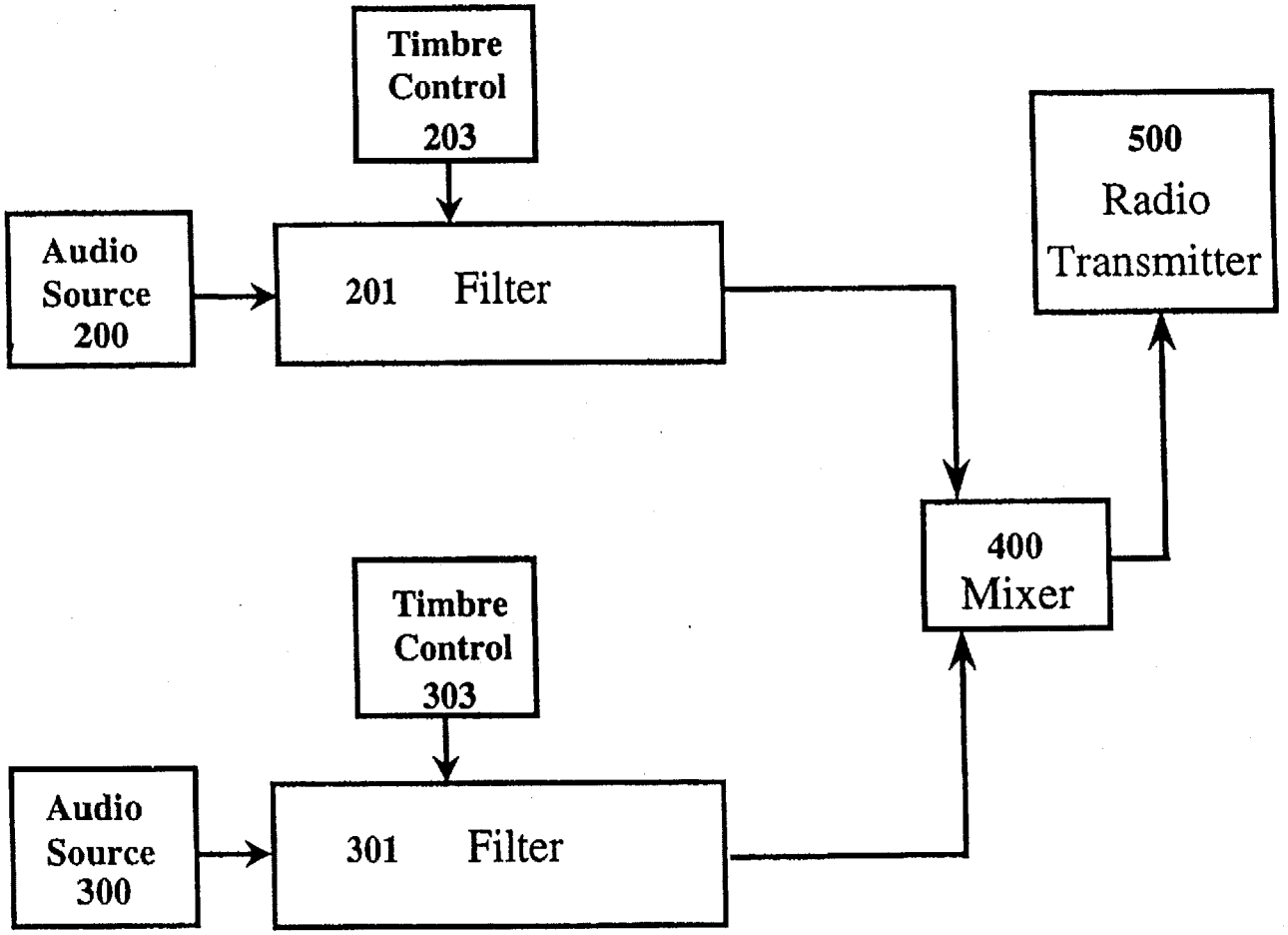

166 1uf capacitor
167 10M resistor
168 CMOS Schmitt-trigger
169 1M resistor
170 Diode
171 1uf capacitor
172 10M resistor
173 100K resistor The circuit consists of a number of touch-sensitive sound-producing modules whose outputs are mixed together and fed into a low-power transmitter. A sound-producing module comprises a variable frequency square-wave oscillator feeding into a band-pass voltage-controlled filter. Optionally, a white-noise source can be added to the input of the filter. The addition of the white-noise source allows the circuit to mimic the sound of the wind. A block diagram of a two-module unit, in which one of the modules includes the white-noise source, is shown in FIG. 2. A detailed schematic of the oscillator, filter, and touch-sensitive controls is given in FIG. 3. A schematic of the low-power transmitter is given in FIG. 4 and a schematic of the white-noise source is given in FIG. 5.

A preferred embodiment of a two-voice synthesizer and transmitter is shown in FIG. 1. A complete electronic music synthesizer 1 is combined with a low-power radio transmitter 2. A pair of metal contacts 3 and 4 provide a touch-sensitive control with which a person can control the frequency of the first of two oscillators. Another pair of metal contacts 5 and 6 provide a touch-sensitive control for the filter which modifies the tone produced by the first oscillator. Similarly, metal contacts 7 and 8 provide a touch-sensitive control for a second oscillator and metal contacts 9 and 10 provide for the control of its associated filter.

FIG. 2 provides a detailed block diagram of the synthesizer. The circuit contains three audio signal sources. Two identical oscillators 11 and 12 are the pitch sources and are controlled respectively by touch-sensitive contact pairs 3,4 and 7,8. A white noise generator 13 provides an additional signal.

The signal from oscillator 11 and white noise generator 13 are fed into a voltage-controlled band-pass filter 14. The signal from oscillator 12 is fed into a similar band-pass filter 15. Negative voltage generator 16 provides a negative 2 volt bias for a voltage-control circuit 17. The voltage control circuit 17 translates the resistance of a fingertip bridging metal contacts 5 and 6 to a voltage controlling the center frequency of filter 14. Similarly, a voltage-control circuit 18 translates a touch on contacts 9 and 10 to a voltage controlling the center frequency of filter 15.

The signals from filters 14 and 15 are combined in a summing amplifier 19 and the resultant signal becomes the input to the low-power transmitter 2.

Figure 3:
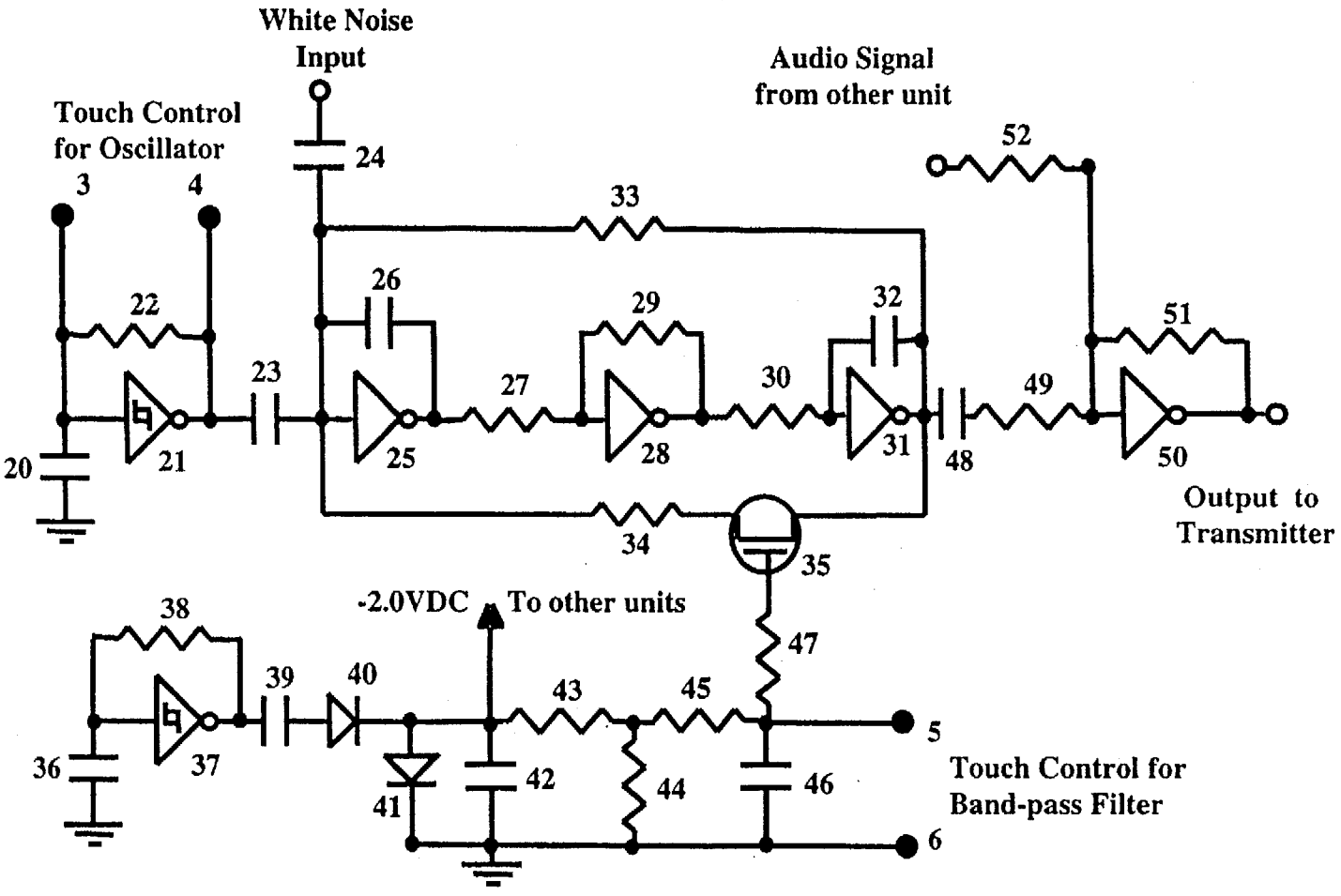
FIG. 3 shows a detailed schematic of one oscillator and filter with touch-sensitive controls.

FIG. 3 shows a detailed schematic of one square-wave oscillator and its associated voltage-controlled band-pass filter. Schmitt trigger 21 is configured as a sub-audio oscillator with capacitor 20 and resistor 22. Metal contacts 3 and 4 allow the user to reduce the effective resistance of resistor 22 by bridging the gap between the contacts with a fingertip. The values of 20 and 22 are chosen so that the nominal frequency the oscillator is one-half cycle per second and to allow normal fingertip resistance to vary the frequency over a ten-octave range.

The square wave pulses generated by this circuit are coupled through capacitor 23 into a state-variable band-pass filter composed of CMOS invertors 25, 28, and 31 and their associated components. Capacitor 26 connects the output of inverter 25 to its input, forming an integrator. Resistor 27 connects the output of integrating inverter 25 to the input of inverter 28 which is configured as a linear amplifier. Feedback resistor 29, in combination with input resistor 27 sets the gain of this amplifier. This amplification factor is the primary determinant of the quality, or "Q" of the filter. Resistor 30 and capacitor 32 form a second integrator with CMOS inverter 31. The output of the second integrator is connected back to the input of the first integrator through resistors 33 and 34 and a junction field-effect transistor 35. Resistors 33 and 34 set the maximum and minimum resistance respectively of the feedback path. FET 35 provides a means of varying the effective resistance of this feedback loop between these maximum and minimum values. The values of resistors 27 and 29 are chosen to give the state-variable filter a high Q value. The value of resistor 30 is chosen to select the nominal resonant frequency of the filter.

Schmitt trigger 37 is configured as a fixed ultrasonic oscillator with timing capacitor 36 and feedback resistor 38. The output of Schmitt-trigger 37 is connected to a charge pump consisting of capacitor 39, diodes 40 and 41, and capacitor 42. When used with a power-supply voltage of 3-volts, this circuit provides a negative 2 volt supply. The output of the charge pump is connected to a voltage-divider consisting of resistors 43 and 44 to provide a negative 1 volt charging voltage through resistor 45 to capacitor 46. This high-impedance network allows a fingertip bridging metal contacts 5 and 6 to discharge the capacitor to a voltage between 0 and−1 volts. This range of voltages, conveyed to the gate of JFET 35 through resistor 47 varies the effective resistance of the state-variable filter feedback loop between the maximum and minimum values set by resistors 33 and 34.

The output signal of the state-variable filter is conveyed through coupling capacitor 48 and resistor 49 to the input of inverter 50 configured as a mixer amplifier with feedback resistor 51. A signal from a second oscillator/filter unit is conveyed to the mixer amplifier through input resistor 52. The mixed signal from this amplifier is connected to the input of the low-power transmitter 2.

There are many possible one or two-transistor low-power transmitters that might be appropriate for use with this invention. One possible embodiment is the FM transmitter shown in FIG. 4. The audio signal from the synthesizer is coupled through capacitor 62 to the base of small-signal high-frequency transistor 70. Bias resistor 64 connects the base of transistor 70 to the 3-volt power supply and capacitor 66 is connected between the base and ground. The collector circuit of transistor 70 consists of a tank circuit composed of capacitor 68 and variable inductor 76. The values of 68 and 76 are chosen to set the nominal frequency in the lower part of the commercial FM frequency band. Capacitor 74 is connected between the collector and emitter of transistor 70 and the emitter is connected to ground through resistor 72. The modulated radio-frequency signal from the center tap of variable inductor 76 is coupled through capacitor 78 to the base of RF amplifier transistor 82. The base of transistor 82 is also connected to the 3-volt power supply through bias resistor 80. The collector of transistor 82 is connected through load resistor 84 to the 3-volt power supply and also to an antenna 86.

This circuit is similar to that of a wireless microphone kit sold under the Radio Shack® name by Tandy Corporation. Component values are different to provide for proper operation with a 3-volt power supply.

Figure 5:
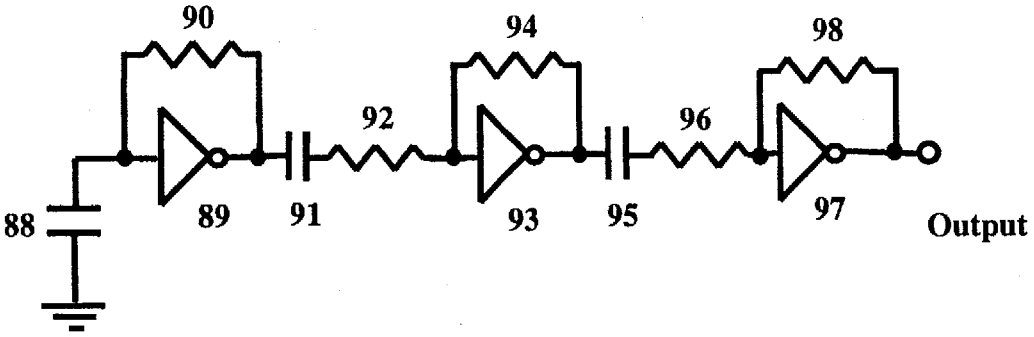
FIG. 5 shows the White Noise generator

FIG. 5 shows a white noise generator in which the inherent thermal noise of a battery and passive circuit elements is amplified to a usable level. The noise is coupled through capacitor 88 to the input of inverter 89. Resistor 90 provides feedback to bias inverter 89 as a high-gain amplifier. The AC output of inverter 89 is coupled through capacitor 91 to an amplification stage consisting of input resistor 92, inverter 93, and feedback resistor 94. Values of resistors 93 and 94 are chosen to set a gain of 10X for this amplifier. Similarly, coupling capacitor 95, input resistor 96, inverter 97, and feedback resistor 98 provide an additional gain of 10X to produce the final high-amplitude white noise signal.

Capacitor 100 couples the inherent noise of the power supply ground to the input of inverter 101. A feedback loop consisting of capacitor 102 and resistor 103 in parallel configures inverter 101 as a high-gain low-pass filter. Capacitor 104 couples the output of inverter 101 to the input of inverter 105 which is configured as a second stage of low-pass gain with capacitor 106 and 107 in parallel in its feedback loop. The resultant high amplitude pink noise signal is available through coupling capacitor 108.

Figure 7:
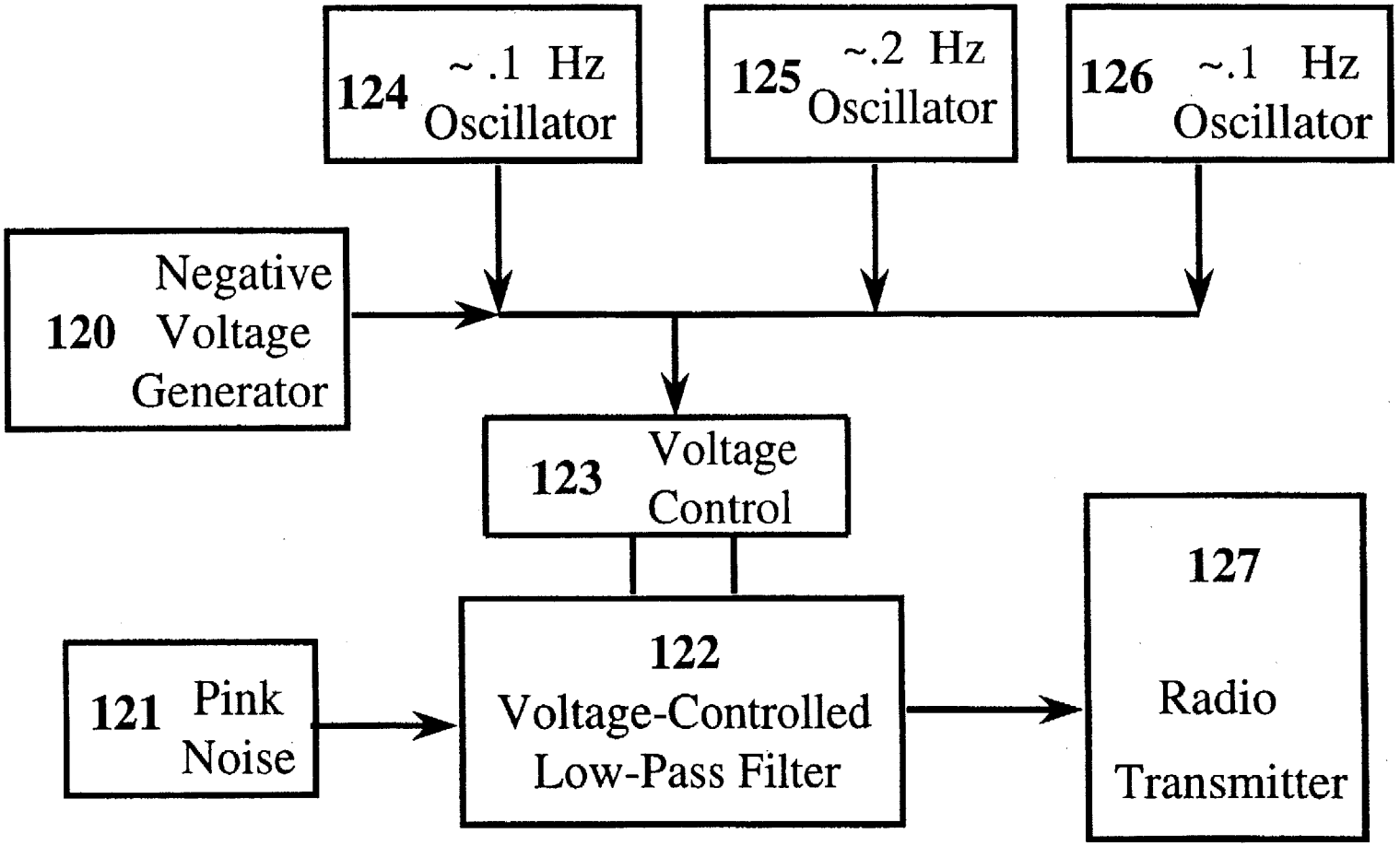
FIG. 7 shows a block diagram of the Surf Synthesizer and Transmitter

A complete block diagram of an alternative embodiment of the invention is given in FIG. 7. Rather than an electronic music synthesizer, this circuit implements a special purpose sound-effect circuit to produce a sound like the pounding of surf on an ocean shore.

Pink noise generator 121 provides a broadband signal with low-frequency emphasis to a voltage controlled low-pass filter 122. The combined outputs of negative voltage generator 120 and sub-audio square-wave oscillators 124, 125, and 126 provide a random, slowly-varying voltage between zero and negative 1.5 volts. This voltage varies the effective resistance of voltage control network 123 to simultaneously vary the gain, cutoff frequency, and Q of low-pass filter 122. The output of voltage-controlled filter 122 is fed into low-power transmitter 127 for broadcast to a standard radio receiver.

Figure 8:
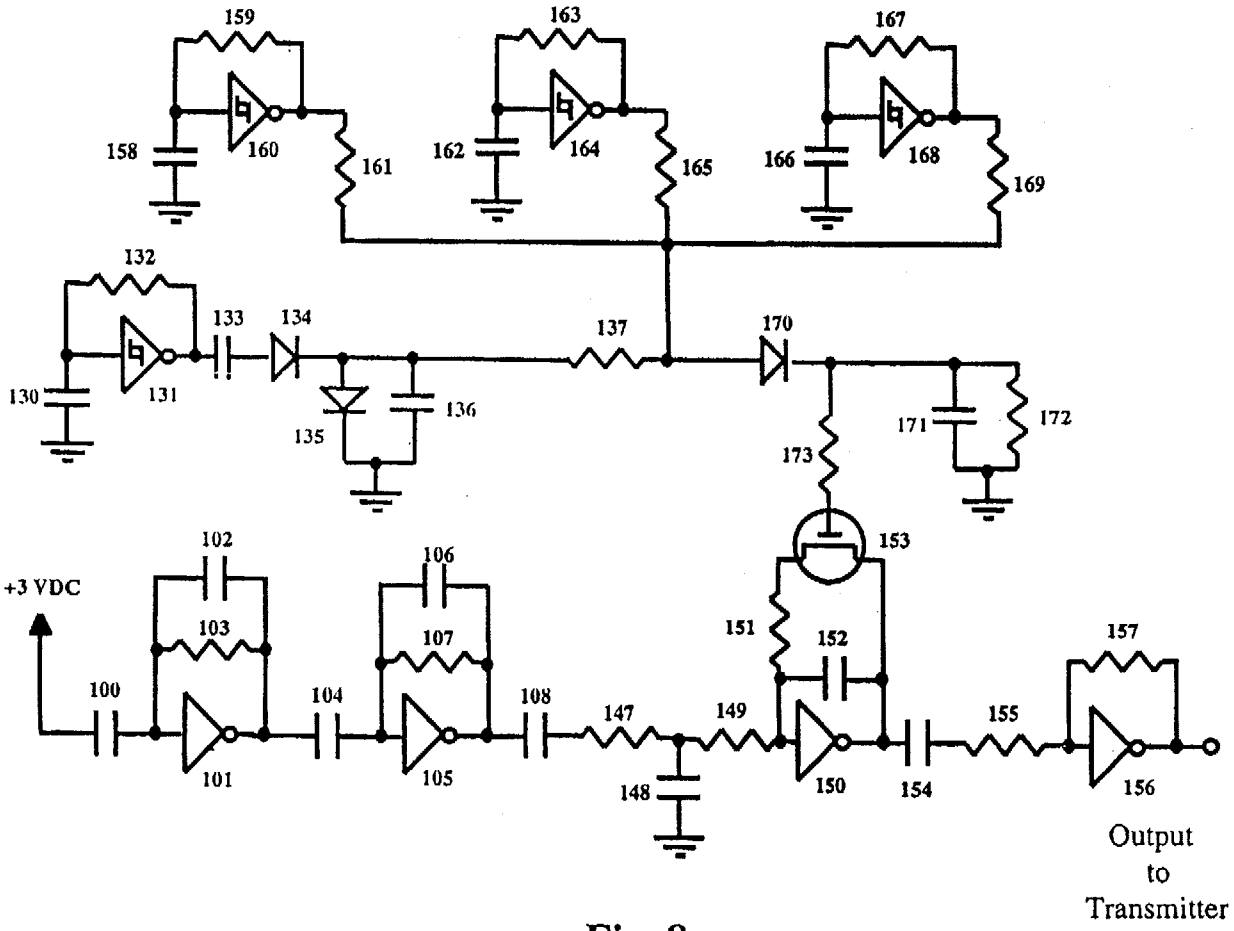
FIG. 8 shows a detailed schematic of the Surf Synthesizer

FIG. 8 shows a detailed schematic of the surf sound-effect synthesizer. The pink noise generator comprised of components 100 through 108 is identical to that shown in FIG. 6. An ultrasonic oscillator consisting of capacitor 130, Schmitt trigger 131, and resistor 132 drives a charge pump consisting of capacitor 133, diodes 134 and 135, and capacitor 136 to produce a negative 2 volt supply.

Three low-frequency oscillators are formed from Schmitt-triggers 160, 164, and 168 with timing resistors 159, 163, and 167, respectively and timing capacitors 158, 162, and 166, respectively. The outputs of these oscillators are combined through resistors 161, 165, and 169, with the output of the negative voltage supply through resistor 137. The result is a slowly varying step function which randomly varies over eight values between 1 volt and negative 1.5 volts.

Diode 170 allows this step-function to rapidly charge capacitor 171 to a negative value, but forces the capacitor to discharge through resistor 172. The result of this asymmetric charging and discharging of capacitor 171 is a fast attack to mimic the crashing of the wave and slower decay to imitate the wave exhausting itself on the shore. Resistor 173 connects the control voltage to the gate of JFET 153 which controls the gain, cutoff frequency, and Q of the low-pass filter.

The low-pass filter is a standard infinite-gain multi-feedback circuit built around inverter 150. Resistors 147, 149, and 151 and capacitors 148 and 152 form the low-pass filter together with the variable resistance of JFET 153. The output of inverter 150 is coupled through capacitor 154 to the input resistor 155 of inverter 156. Feedback resistor 157 establishes the gain of the final signal to the transmitter.

Several simplifications in sound generation, filtering and control are made possible by using CMOS digital invertors as linear amplifying elements. The technique of using negative feedback to convert a CMOS digital inverter into a linear amplifier is described in *RCA COS/MOS Digital Integrated Circuit Selection Databook*, "Application Note 6086—Timekeeping Advances Through COS/MOS Technology" by S. S. Eaton, published by RCA in 1973. The CMOS digital invertors employed are those found in the CD4049, CD4069, or 74HC04 integrated circuits.

The amplification elements are CMOS invertors which have been self-biased into linear operation by connecting the output through a resistor to the input. Signal paths between self-biased stages must be made through capacitive coupling to allow each inverter to maintain its proper bias point. Complex arrangements of direct-coupled invertors are possible if they contain an odd number of inverting stages and a DC feedback loop. Such a negative feedback loop will ensure that all of the invertors are biased in their linear modes. Robert Pease teaches away from this design technique in "Troubleshooting Analog Circuits", Chapter 10, p. 120, Butterworth-Heinemann, 1991, with the statement: "At low voltages, you can make a mediocre amplifier this way, but when the supply is above 6 V, the power drain gets pretty heavy and the gain is low. I don't recommend this approach for modern designs. "When CMOS invertors are operated in this mode, power dissipation and maximum gain are strongly affected by the power supply voltage. The maximum voltage gain for a CMOS inverter is approximately 40 and this value is achieved only at the lowest possible operating voltage of 3 volts. When biased for linear operation, both transistors in the complementary pair are in a conducting state. If the power supply voltage is kept at 3 volts, the linear bias $V_{GS}$ for both transistors is near their threshold values of 1.5 volts. With both transistors biased near their threshold values, they do not fully conduct and the total current remains low. This raises a problem for voltage-controlled circuits such as those described in this application. With the power supply of 3 volts, the bias point of the invertors with negative feedback is 1.5 volts. To use n-channel field effect transistors as controlling elements in feedback networks biased at approximately 1.5 volts, it is necessary to vary the n-channel FET gate between zero and−1 volts, a range of voltages outside the available power supply. The addition of a negative voltage generator in the form of a simple charge pump built around a CMOS Schmitt trigger provides a negative voltage source to extend the range of available control voltages.

The characteristic sound of electronic musical instruments results from the ability to rapidly alter the harmonic content of a sound. This is generally accomplished with voltage-controlled filters. The state-variable filter topology employed in this invention was first presented in 1967 by L. P. Huelsman, W. J. Kerwin, and R. W. Newman in "State Variable Synthesis for Insensitive Integrated Circuit Transfer Functions.", *IEEE Journal of Solid-State Circuits*, Volume SC-2, Number 3, September 1967.

The state-variable filters are constructed by joining two amplifiers, 25 and 31, configured as integrators with time constants in the low-audio range with a third amplifier, 28, to provide overall negative feedback with the necessary amplification to give the state-variable filter a very high "Q" and keep it near self-oscillation. When excited by the 0.5 cycle-per-second pulses coming from Schmitt-trigger oscillator 21, the filter produces a momentary oscillation which dies away quickly. Component values of the state-variable filter are chosen so that with no fingertip contact between contacts 5 and 6, the center frequency of the filter is set to an appropriate audio frequency. This frequency can be set high for a sound like metal chimes, or low for a drum like sound.

In the preferred embodiment, an FM transmitter broadcasts the synthesized sound to a standard FM radio receiver within a range of fifty feet from the transmitter. The specific requirements for the power and range allowed for the transmitter are specified in Article 15 of the rules and regulations of the Federal Communications Commission. The operation of the transmitter is subject to the same restrictions as wireless microphones.

Figure 4:
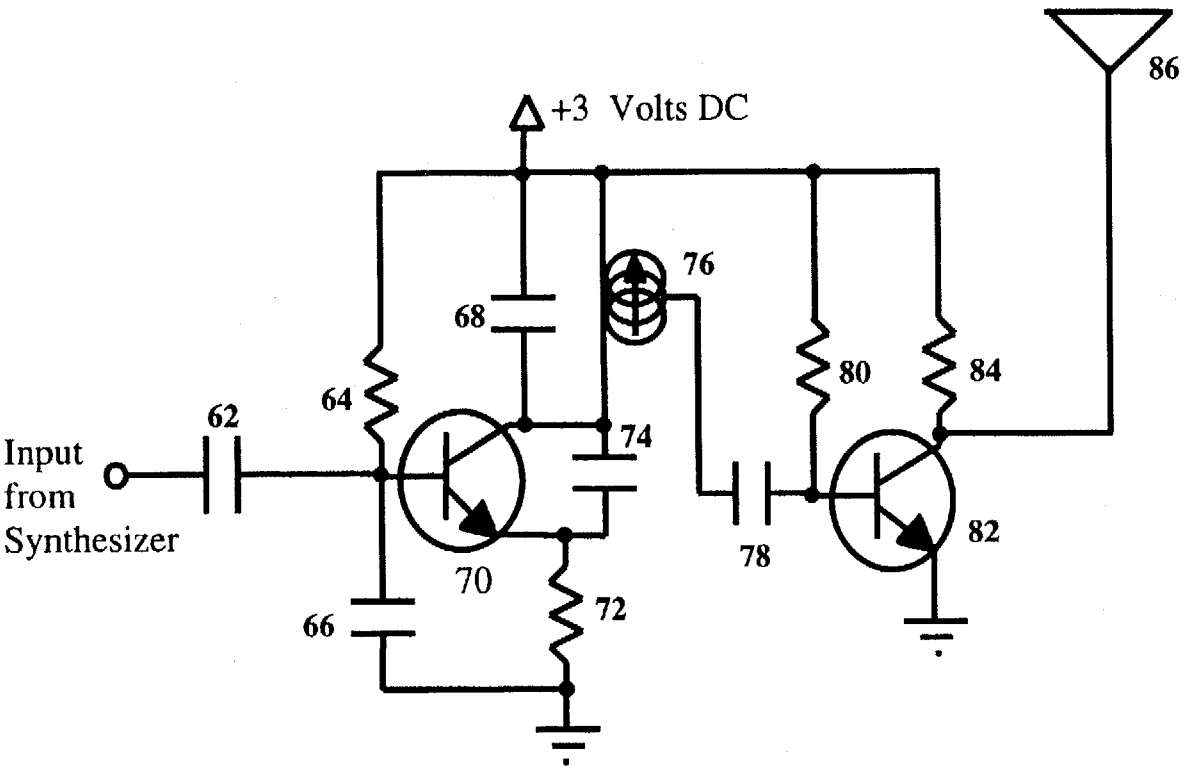
FIG. 4 shows the low-power FM transmitter.

The preferred embodiment shown in FIG. 4 contains an FM modulator and a final amplifier. The modulator consists of transistor 70, a tuned circuit consisting of capacitor 68 and coil 76, and bias resistors 64 and 72 and capacitors 66 and 74. The final amplifier comprised of resistor 80, transistor 82 and resistor 84 isolates the FM modulator from the antenna. This configuration reduces the possibility that contact with the antenna or movement of the transmitter will affect the frequency of transmission.

Figure 6:
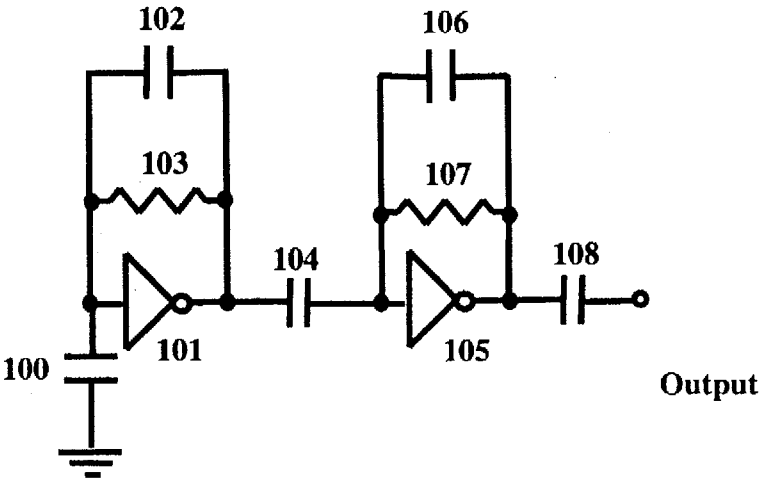
FIG. 6 shows the Pink Noise generator

The white and pink noise generators in FIGS. 5 and 6 are ideal for battery powered systems. They function by amplifying the inherent noise of the power source plus the noise generated in other parts of the circuit which finds its way to the power supply ground. Also, the CMOS inverter amplifiers are not low-noise amplifiers and they contribute significantly to the noise level. It is for this reason that several independent stages are cascaded rather than creating a single feedback loop around a high-gain configuration such as three invertors in series.

When CMOS invertors are operated in their linear mode at 3 volts, their available voltage gain is at its maximum value of about 40. This is exploited in the pink noise generator which requires only two stages, yet produces strong low-frequency components. The coupling capacitors 100, 104, and 108 have higher values than signal coupling capacitors in the music synthesizer because they must transfer the low-frequency signals efficiently. Also, the amplifier input resistors in the white noise generator, 92 and 96, are eliminated in the pink noise generator to exploit the maximum low-frequency gain of the invertors.

The remarkably realistic imitation of pounding surf produced by the circuit shown in FIGS. 7 and 8 is principally due to two things. The first is the substantial amplitude of the low-frequency noise available from the new pink noise generator 121. The second is the high Q value of the low-pass filter when the cutoff frequency is at its lowest value. The high Q of this circuit results in a resonant peak in the frequency response. The combination of high amplitude low-frequency noise and a filter with a sharp resonant peak produces a deep boom just like that of a large wave.

When the control voltage value is at negative 1.5 volts, the gain and Q of the filter are at their maximum values and the cutoff frequency is at its minimum. When two or more of the low-frequency oscillators 124, 125, and 126 in FIG. 7 are in the high-voltage state, the control voltage rises slowly to zero volts. As the control voltage approaches zero volts, the Q and gain of the filter decrease and the cutoff frequency goes to its highest frequency. The resulting sound is like the quiet hiss of bubbles on the sand as a wave exhausts itself on a beach. At zero volts the gain of the filter is low enough to silence the sound completely.

Active filter design generally attempts to reduce the interaction between the circuit parameters of gain, Q, and cutoff frequency. In this circuit, however, the simultaneous variation of these three parameters exactly matches the desired behavior.

This patent application describes a low-power electronic music synthesizer combined with a radio transmitter for use in musical instruments, audio-kinetic sculptures, and toys. The circuits comprise a low-voltage circuit implementing a multiple-voice analog music synthesizer and sound-effect generators and a low-power FM transmitter. Variations in sound are produced by touching metal contacts which are sensitive to the range of resistance and capacitance of human fingertips.

These circuits improve upon sound-making toys by creating a wide range of high-fidelity sounds using readily available radio receivers as the sound-producing medium. Sound-producing toys with built-in amplifiers and speakers require more power and produce inferior sound quality.

The combination of low-voltage, low-power, high-fidelity sound generation and touch sensitive controls make this ideal for a new kind of toy. Due to the low-voltage and low-power requirements, the circuit can operate for approximately forty hours using two 1.5 volt AA cells. In the demonstration models an FM transmitter is employed, but any suitable part of the radio spectrum may be used subject to FCC emission regulations and the availability of receivers.

Modern analog music synthesizers are universally designed around operational amplifiers. With appropriate circuit design changes, CMOS invertors operating in their linear regions can be substituted for these operational amplifiers. A substantial reduction in cost is achieved thereby. Four operational amplifiers are available in 14-pin integrated circuit packages for approximately 30 cents per amplifier. Six CMOS invertors are available in 14-pin packages for approximately 4 cents per amplifier. The result is a lower per-amplifier price and reduced parts count for a complete system.

I claim:

1. A portable, low-power audio synthesizer and transmitter apparatus comprising:

a) a direct current power supply having positive and negative output at which positive and negative voltage, respectively, are present;

b) an audio source having an output;

c) a control voltage generator having an output and comprising:

(i) a negative voltage source having an output voltage;

(ii) touch-sensitive means, coupled to the negative voltage source and the power supply, for producing control voltages between a range from the output voltage of the negative voltage, source to the positive output voltage of the power supply;

d) a filter coupled to the control voltage generator output, the filter having an input, an output and frequency, gain and resonance characteristics, the filter input being coupled to the output of the audio source; and e) a radio frequency transmitter having a modulation input coupled to the output of the filter.

2. The apparatus of claim 1 wherein the filter is a voltage-controlled filter, and further comprises a control input for receiving a control voltage to control at least one of the gain, frequency and resonance characteristics of the filter.

3. The apparatus of claim 1 wherein the audio source comprises a variable oscillator having a control input for receiving a control voltage generated by the control voltage generator for controlling the frequency of the oscillator.

4. The apparatus of claim 1 wherein the audio source comprises a noise generator.

5. The apparatus of claim 1 further comprising:

an audio mixer interconnected between the output of the filter and the modulation input of the radio transmitter.

6. The apparatus of claim 1, wherein the touch sensitive means comprises:

i) a high-impedance voltage divider comprising a first resistor connected between the negative voltage source and the control voltage generator output and a second resistor connected between one of the power supply outputs and the control voltage generator output;

ii) an insulating enclosure; and iii) a pair of conductive contacts attached to the insulating enclosure, the first contact electrically coupled to the control voltage generator output and the second contact electrically coupled to one of the power supply outputs.

7. The apparatus of claim 4 wherein the noise generator comprises a plurality of serially coupled low-frequency amplifiers, each amplifier having an input and an output, the input of a first of the low-frequency amplifiers coupled to the positive output of the power supply, each subsequent $n^{th}$ low-frequency amplifier having the input thereof coupled to the output of the $(n-1)^{th}$ low-frequency amplifier and the output thereof coupled to the input of the (n+1)th low-frequency amplifier, the output of a last of the plurality of low-frequency amplifiers serving as the output of the noise generator.

8. The apparatus of claim 7 wherein at least one of the low-frequency amplifiers comprises:

i) a CMOS inverter having an input and an output, ii) a resistor connected between the inverter input and the inverter output, iii) a capacitor connected between the inverter input and the inverter output, and iv) a coupling capacitor having a first lead coupled to the input of the inverter and a second lead serving as the input to the low-frequency amplifier, the output of the inverter serving as the output of the low-frequency amplifier.

9. The apparatus of claim 2, further comprising a low-frequency random voltage generator having an output coupled to the control input of the voltage-controlled filter.

10. The apparatus of claim 9 wherein the low-frequency random voltage generator comprises:

(i) a plurality of square wave oscillators, each oscillator having an output and producing a signal in the sub-audio range;

(ii) a control-voltage diode having an anode and a cathode, the output of each square wave oscillator connected to the anode of the control-voltage diode through a resistor, the anode of the control-voltage diode further connected to the negative voltage source through a resistor;

(iii) an electrolytic capacitor having a negative lead coupled to the cathode of the control-voltage diode and a positive lead coupled to the power supply ground; and (iv) a resistor connected in parallel with the electrolytic capacitor, the negative lead of the electrolytic capacitor serving as an output of the low-frequency random voltage source.

11. The apparatus of claim 2 wherein the voltage-controlled filter comprises:

(i) a state-variable band-pass filter, having and an output;

(ii) an n-channel field-effect controlled transistor having source, gate and drain terminals; and (iii) a minimum-gain setting resistor having first and second leads; the output of the state-variable band-pass filter connected to the drain of the field- effect control transistor, the source of the field-effect control transistor connected to a first lead of the minimum-gain setting resistor, the other lead of the resistor connected to the input of the band-pass filter.

12. The apparatus of claim 11 wherein the a state-variable band-pass filter comprises:

(i) first and second integraters, each having an input and an output;

(ii) an inverting amplifier having an input and an output;

(iii) a gain-setting feedback resistor having two leads; and the output of the first integrator connected to the input of the inverting amplifier, the output of the inverting amplifier connected to the input of the second integrator, the output of the second integrator connected to one lead of the gain-setting feedback resistor, the other lead of the gain-setting feedback resistor connected to the input of the first integrator, the input of the first integrator serving as the input of the state-variable band-pass filter and the output of the second integrator serving as the output of the state-variable band-pass filter.

13. The apparatus of claim 12 wherein at least one of the integraters comprises a CMOS inverter having an input and an output and an integrating capacitor connected between the inverter input and output, and an input resistor having a first lead connected to the input of the inverter.

14. The apparatus of claim 13 wherein the inverting amplifier comprises a CMOS inverter having an input and an output, a feedback resistor connected between the inverter input and output, and an input resistor having a first lead connected to the input of the inverter.

15. A portable, low-power audio synthesizer and transmitter apparatus comprising:

a) a direct current power supply having inherent thermal noise present at an output thereof;

b) amplification means, coupled to the power supply output for amplifying at least a portion of the thermal noise to create a signal;

c) a touch-sensitive filter, operatively coupled to the amplification means for selectively modifying the signal, and d) a radio-frequency transmitter, operatively coupled to the touch-sensitive filter.

16. The apparatus of claim 15 wherein the touch-sensitive voltage control filter comprises:

(i) a touch-sensitive voltage control source having an output; and (ii) a voltage controlled filter having an input and an output and a control input; the output of the touch-sensitive voltage control source coupled to the control input of the voltage control filter.

17. The apparatus of claim 16 wherein the touch-sensitive voltage control source comprises:

(i) an insulating enclosure;

(ii) a negative voltage source having an output;

(iii) a voltage divider comprising two resistors coupled between the output of the negative voltage source and electrical ground;

(iv) an electrolytic capacitor having positive and negative leads; and (v) a resistor;

the resistor coupled between the negative voltage source and the negative lead of the electrolytic capacitor, the positive lead of the electrolytic capacitor connected to the power supply output, both leads of the electrolytic capacitor coupled to the insulating enclosure so that a conductive material can be brought into contact with the positive and negative leads, causing electrical connection between the respective leads in accordance with the pressure with which the conductive material is brought in contact with the leads.

18. A method of synthesizing audible signals comprising the steps of:

a) providing a source of audio signals;

b) providing a touch-sensitive controller capable of receiving input signals, the touch-sensitive controller coupled to the audio source;

c) modifying the frequency of the audio signals in response to the input signals of the touch-sensitive controller; and d) transmitting the modified audio signals over a radio frequency to a remote amplifier for amplification thereof.

19. The method of claim 18 wherein the source of audio signals comprises a variable oscillator.

20. A method of synthesizing audible signals comprising the steps of:

a) providing a noise generator as a source of audio signals;

b) providing a touch-sensitive controller capable of receiving input signals, the touch-sensitive controller coupled to the noise generator;

c) modifying the audio signals in response to the input signals of the touch-sensitive controller; and d) transmitting the modified audio signals over a radio frequency to a remote amplifier for amplification thereof.

21. A method of synthesizing audible signals comprising the steps of:

a) providing a filter as a source of audio signals;

b) providing a touch-sensitive controller capable of receiving input signals, the touch-sensitive controller coupled to the filter;

c) modifying the audio signals in response to the input signals of the touch-sensitive controller; and d) transmitting the modified audio signals over a radio frequency to a remote amplifier for amplification thereof.

* * * * *